US005884783A

United States Patent [19]

Proulx

[11] Patent Number: 5,884,783

[45] Date of Patent: Mar. 23, 1999

[54] HOLDER FOR TACO SHELL OR THE LIKE

[76] Inventor: Michel Proulx, 90 De Candiac, Apt. 2, Gatineau, Quebec, Canada, J8R 1Z3

[21] Appl. No.: 104,436

[22] Filed: Jun. 25, 1998

Related U.S. Application Data

[63] Continuation-in-part of Ser. No. 756,159, Nov. 25, 1996.

[51] Int. Cl.[6] ..... B65D 5/00

[52] U.S. Cl. ..... 211/85.4; 211/70.1; 229/938; 229/904; 248/174

[58] Field of Search ..... 211/85.4, 126.16, 211/70.1, 13.1, 135; 229/938, 904; 248/174

[56] References Cited

U.S. PATENT DOCUMENTS

| | | | |
|---|---|---|---|
| 1,172,667 | 2/1916 | Bunnell | 211/85.4 X |
| 2,035,021 | 3/1936 | Pyle et al. | 248/174 |
| 2,100,077 | 11/1937 | Harrison | 248/174 X |
| 2,992,764 | 7/1961 | Goding | 229/904 X |
| 3,002,722 | 10/1961 | Cote | 248/174 |
| 4,105,182 | 8/1978 | Jacobson | 248/174 X |
| 4,267,955 | 5/1981 | Struble | 229/904 X |
| 4,722,504 | 2/1988 | Degenholtz | 248/174 X |
| 4,746,010 | 5/1988 | Fournier | 211/85.4 X |
| 4,896,820 | 1/1990 | Harrington | 229/938 X |
| 5,203,493 | 4/1993 | Moody | 229/938 X |

FOREIGN PATENT DOCUMENTS

| | | | |
|---|---|---|---|
| 1047589 | 7/1953 | France | 211/70.1 |
| 1234278 | 5/1960 | France | 211/70.1 |

*Primary Examiner*—Peter M. Cuomo
*Assistant Examiner*—David E. Allred
*Attorney, Agent, or Firm*—Swabey Ogilvy Renault; Guy J. Houle

[57] ABSTRACT

A holder for a taco shell or the like is formed with a taco shell receiving trough which is adapted for supporting a taco shell substantially upright. The taco shell receiving trough is defined by a narrow longitudinal support base panel having opposed longitudinal spaced-apart straight edges. An outwardly inclined rectangular side wall panel extends from each of the straight edges to form a substantially V-shaped receiving trough. A brace panel of rectangular shape extends from a straight top edge of each of the side wall panels and extends at an outward angle therefrom to a flat, surface engaging, support foot lying in a substantially common or parallel plane with the support base panel. A composite bottom connecting wall maintains the support base panel, the side wall panels, the brace panels and the support feet in a taco support position.

5 Claims, 4 Drawing Sheets

HOLDER FOR TACO SHELL OR THE LIKE

CROSS-REFERENCE TO RELATED APPLICATION

This application is a continuation-in-part of application Ser. No. 08/756,159, filed Nov, 25, 1996.

TECHNICAL FIELD

The present invention relates to a holder for a taco shell or the like foodstuff and wherein the holder is provided by a pair of opposed inverted V-shaped panels secured to a central support base panel to form a substantially V-shaped receiving trough and wherein support feet project at opposed ends of the inverted V-shaped panels. The holder maintains a taco shell in an upright support position.

BACKGROUND ART

Various taco shell holders are known for supporting a taco shell with foodstuff therein in an upright position. Examples of these taco shell holder constructions can be found in, for example, U.S. Pat. Nos. 4,872,566, 4,925,032, and 5,005,704. Most taco shell holders are for single use only and provide the function of holding the taco shell upright on a support surface whereby to place foodstuff in the taco shell trough and some of these holders are also used to hold a taco shell to facilitate heating the taco and simultaneously providing a sanitary function.

SUMMARY OF INVENTION

The taco holder of the present invention is of simple construction and its main purpose is for holding a taco shell upright on a flat support surface for filling the taco with foodstuff and also permits the taco to be manipulated on the flat surface. The taco shell holder of the present invention can also be made from a cardboard blank which may be integrated on a panel of a taco shell box or inserted into the box as a blank sheet which can contain several taco holder blanks which are easily assembled. The support can also permit more than one taco shell to be supported thereby.

It is a feature of the present invention to provide a holder for a taco shell or the like foodstuff material, and wherein the holder is easy to construct and capable of maintaining a taco shell upright on a flat support surface.

Another feature of the present invention is to provide a holder for a taco shell or the like, which is formed from a blank of cardboard material and which is easy to assemble and also capable of holding one or more taco shells in an upright position on a flat support surface.

Another feature of the present invention is to provide a holder for a taco shell or the like, wherein the holder is formed by a blank of paperboard material, such as thin cardboard and wherein several blanks may be formed in a sheet and detached therefrom by score lines.

According to the above features, from a broad aspect, the present invention provides a holder for a taco shell or the like, and wherein the holder comprises a taco shell receiving trough adapted for supporting a taco shell substantially upright on a support surface. The receiving trough is defined by a narrow longitudinal support base panel having opposed longitudinal spaced-apart straight base fold edges. An outwardly inclined rectangular side wall panel extends from each of the straight base fold edge to form a substantially V-shaped taco shell receiving trough. A solid surface brace panel extends from a straight top edge of each of the side wall to a peak fold line. Each base panel projects at an outward angle therefrom to a straight connecting panel fold line of a flat, surface-engaging underlying connecting panel adapted to lie in a substantially common or parallel plane with the support base panel when a load is disposed over the support base panel. The underlying connecting panels bridge the straight base fold edges of the support base panel and the straight fold line. Connecting means is provided at a free end of the underlying connecting panels and the support base panel to maintain the support base panel, the side wall panels, and the underlying connecting panels oriented in a taco shell support position. The underlying connecting panels when secured to the base panel provide a spring action causing the taco shell receiving trough to be maintained in an elevated open flared position over the support surface whereby when a taco shell is disposed into the trough, the base panel will descend to the support surface and simultaneously cause the side wall panels to move inwardly towards one another to embrace the taco shell from opposed sides thereof to maintain the taco shell upright on the support surface.

According to a further broad aspect the holder is fabricated as a twin holder and there is provided between the pair of taco shell receiving troughs a top spacer rectangular panel so as to provide a space between the taco shell receiving troughs to permit proper positioning and grasping of taco shells therein.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
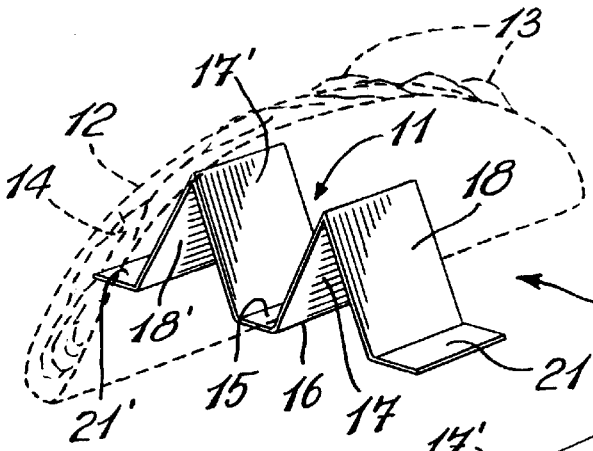
FIG. 1 is a perspective view showing a holder for a taco shell which is constructed in accordance with the present invention and molded from plastics material.

Referring now to the drawings and more particularly to FIGS. 1 to 4, there will be described the taco shell holder of the present invention generally identified by reference numeral 10. As shown in FIG. 1, the holder 10 is formed of plastic molded material and defines a rigid taco shell receiving trough 11 adapted for supporting a taco shell 12, as hereinshown in phantom lines, in a substantially upright position whereby foodstuff 13, as shown by phantom lines, can be placed within the taco shell cavity 14.

The receiving trough 11 is defined by a narrow longitudinal support base panel 15 having opposed longitudinal, parallel spaced apart straight edges 16 and 16'. Outwardly inclined rectangular side wall panels 17 and 17' extend from each of the straight edges 16 and 16', respectively, to form a substantially V-shaped taco shell receiving trough 11 as better illustrated in FIG. 3. Brace panels 18 and 18' are connected respectively and extend downwardly and angularly outwards from straight top edges 19 and 19' of the side wall panels 17 and 17', respectively, and each terminate along bottom straight edges 20 and 20', respectively, into flat, surface engaging, support feet 21 and 21', respectively. The feet 21 and 21' are comprised by flat panels which extend in a substantially common plane or parallel with the support base panel 15 when in an assembled condition, as shown in FIG. 3.

Figure 2:
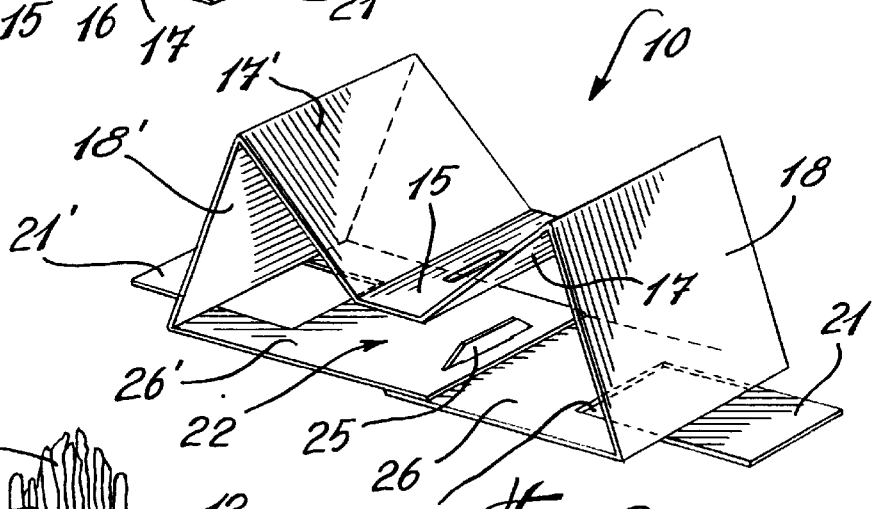
FIG. 2 is a further perspective view showing a holder for a taco shell formed in accordance with the present invention and comprised of a blank of cardboard material and with the support base panel thereof shown in a pre-assembled position.
Figure 3:
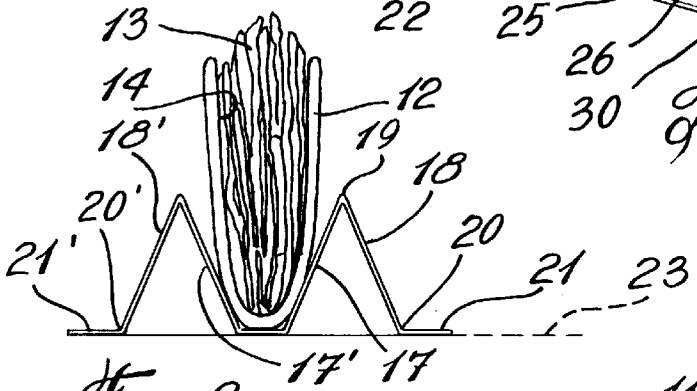
FIG. 3 is an end view of the holder of the present invention fully assembled, and illustrating a taco shell supported upright therein.
Figure 4:
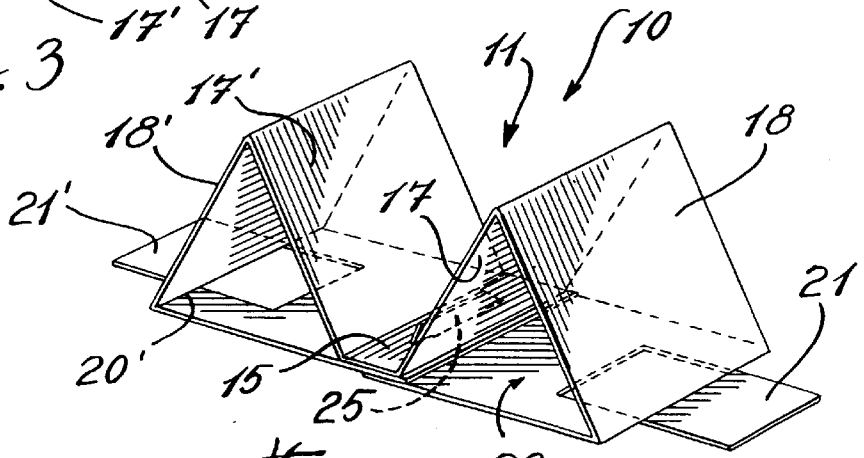
FIG. 4 is a perspective view of the taco holder of the present invention and illustrating one form of connection of the support base panel to the bottom connecting wall.

Means is provided to maintain the support base panel 15, the side wall panels 17 and 17', the brace panels 18 and 18' and the support feet 21 and 21' oriented in a taco shell support position, as shown in FIG. 3. This means is constituted in FIG. 1 by having the taco shell holder 10 formed from rigid plastic material and the holder herein is a plastic injected element. As shown in FIGS. 2 to 4, this means to maintain the walls and panels oriented in a support position is constituted by a composite bottom connecting wall generally identified by reference numeral 22 and which bridges the opposed brace wall panels 18 and 18' from the lower straight edge thereof which lie in a common, substantially flat plane 23, as illustrated in FIG. 3. As can be seen the support feet 21 and 21' also lie in this flat support plane.

Figure 5:
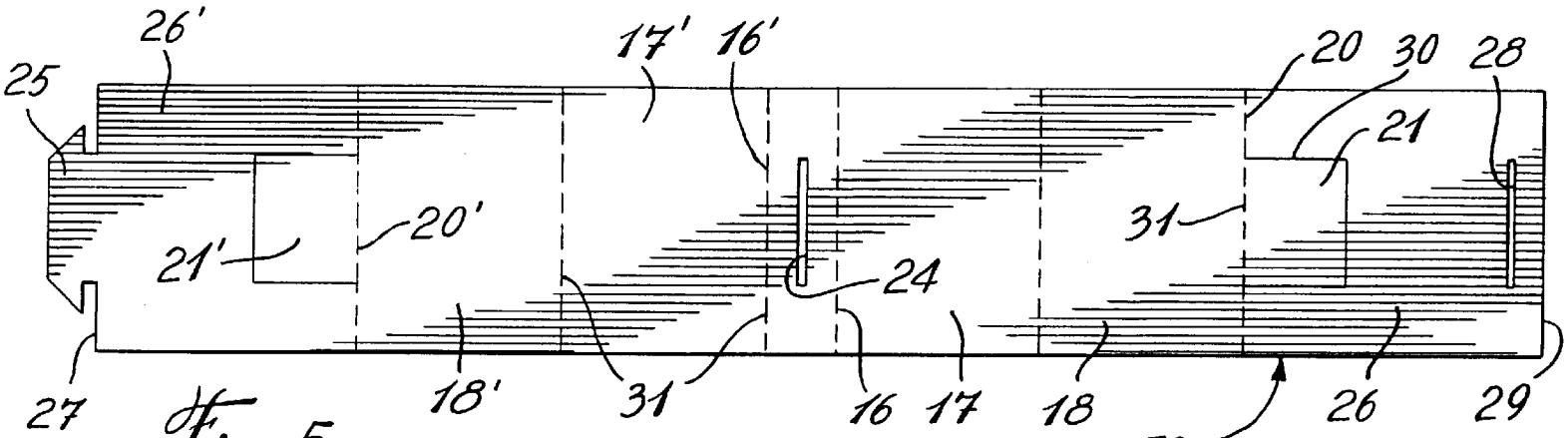
FIG. 5 is a plan view showing a blank with a taco shell holder of the present invention delineated therein.

As shown in FIGS. 2, 4 and 5, the support base panel 15 is also provided with connecting means, herein shown in the form of a slot 24, which extends adjacent one of the straight edges, herein edge 16 of the support base panel 15. This slot 24 is dimensioned for receiving therethrough an attachment tab 25 for connecting the support base panel 15 to the bottom connecting wall 22. Accordingly, the taco shell receiving trough is disposed substantially centrally of the taco shell holder 10 and immovably retained in this position when the blank 50, shown in FIG. 5, is assembled.

As shown in FIGS. 2 and 5, the composite bottom connecting wall 22 is formed by two panel sections 26 and 26', each extending from a respective one of the lower straight edges 20 and 20' of the brace wall panels 18 and 18', respectively. These two panel sections 26 and 26' are folded inwardly towards the support base panel, as shown in FIG. 2, and are interconnected together by placing the attachment tab 25 which is shown in FIG. 5 as being formed in the end edge 27 of the panel section 26', through a connecting slot 28 which is formed adjacent the end edge 29 of the panel section 26. The connecting tab 25 protrudes through this connecting slot 28 and as above-described is also passed through the connecting slot 24 formed in the support base panel 15 to also secure the base panel to the composite bottom connecting wall 22.

As shown in FIGS. 2, 4 and 5, the support feet 21 and 21' are also formed from the blank 50 and delineated by perforations or slits 30 formed within the two panel sections 26 and 26'. As shown in FIG. 5, all of the panels and support feet are interconnected by fold lines or fold perforations which extend parallel to one another and transversely to the longitudinal rectangular strip blank 50. A few of these fold lines are identified by reference numeral 31.

Figure 6:
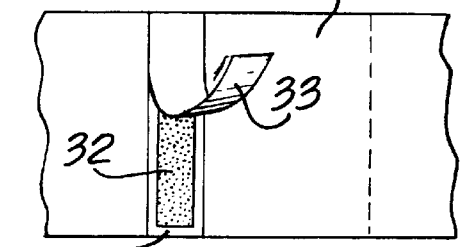
FIG. 6 is a fragmented plan view showing an alternative connection means for securing the support base panel to the bottom connecting wall.

FIG. 6 illustrates a further example of the connecting means to secure the support base panel 15 to the bottom connecting wall 22. As hereinshown the support base panel 15 may be provided on the underside thereof with a glue strip 32 having a protective peel-off sheet 33 positioned thereover and having silicon release coating, as is well known in the art. By simply aligning the support base panel 15 substantially centrally over the bottom connecting wall 22 and pressing down onto the connecting wall, the support base panel 15 becomes attached. Of course, other forms of attachment means may be provided.

Figure 7:
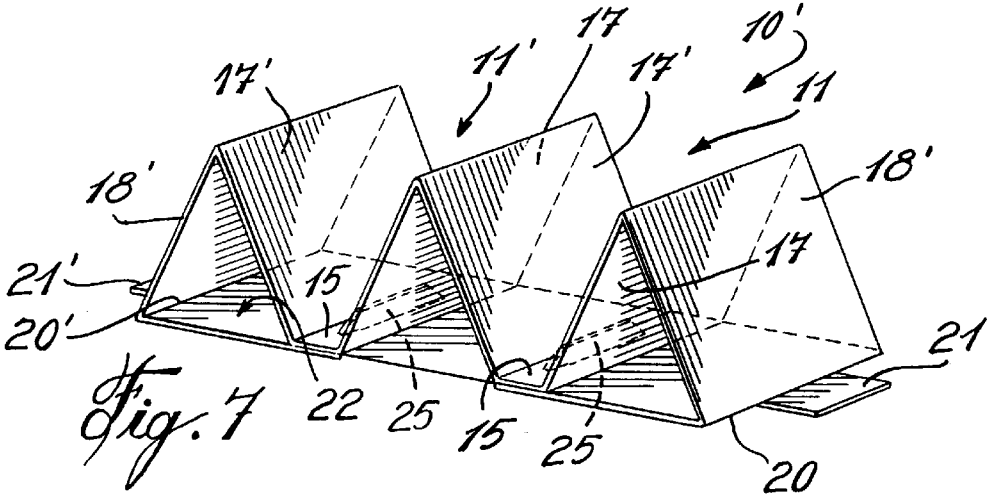
FIG. 7 is a perspective view illustrating the taco shell holder of the present invention formed as a multiple taco shell holder for supporting two taco shells in an upright position.

As shown in FIG. 7, the taco shell holder as generally indicated by reference numeral 10' is provided with two V-shaped taco shell support troughs 11' to support two taco shells in a side-by-side relationship. These troughs are separated by their opposed side wall panels 17 and 17' but only the outer side wall panels have base wall panels 18 and 18' with support foot panels 21 and 21' formed along their outer bottom edges 20 and 20'. The blank is also formed with two connecting slots 28 and two attachment tabs 25 formed in the blank in a manner well known to a person skilled in the art.

Figure 8:
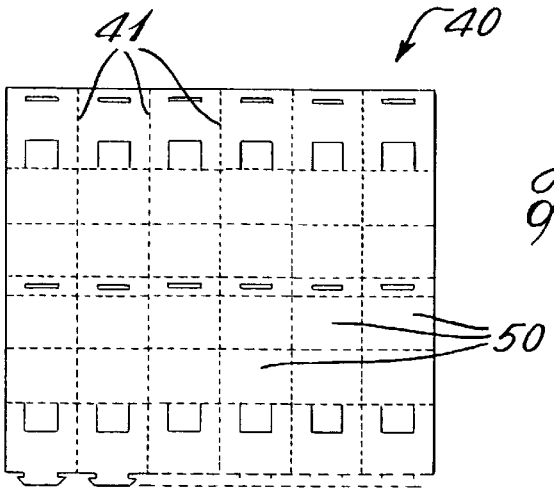
FIG. 8 is a plan view of a paperboard sheet showing a plurality of taco shell holder blanks of the present invention formed therein.
Figure 9:
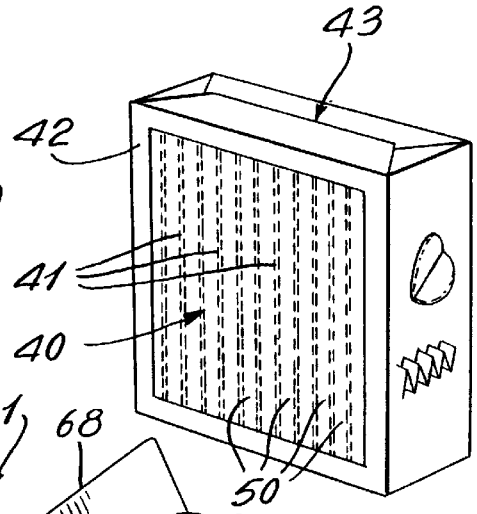
FIG. 9 is a perspective view of a taco shell box-like package having a panel thereof formed with a plurality of taco shell holder blanks.

FIGS. 8 and 9 illustrate that the blank strips 50, as shown in FIG. 5, or those for supporting dual taco shells, as illustrated in FIG. 7, may be formed from a single sheet of paperboard material as shown at 40 in FIG. 8 and comprising a plurality of these rectangular blanks 50 which are interconnected in side-by-side relationship by detachable score lines 41. As shown in FIG. 8, this sheet 40 may be integrated within a rear wall 42 of a taco shell carrying box 43. Alternatively, a sheet similar to that as shown in FIG. 8, may be placed inside the taco shell box 43 and the strips 50 detached therefrom along their score lines 41.

Figure 10:
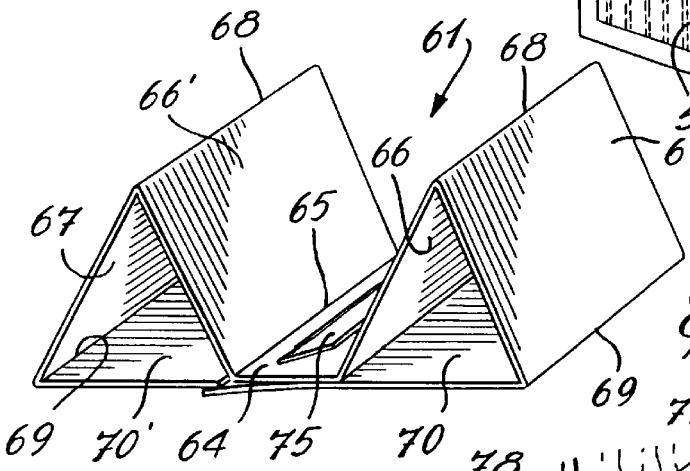
FIG. 10 is a perspective view showing a holder for a taco shell constructed in accordance with a further modification of a preferred embodiment of the present invention and shown in its position when a load, such as a taco shell filled with foodstuff, is disposed within the receiving trough.
Figure 11:
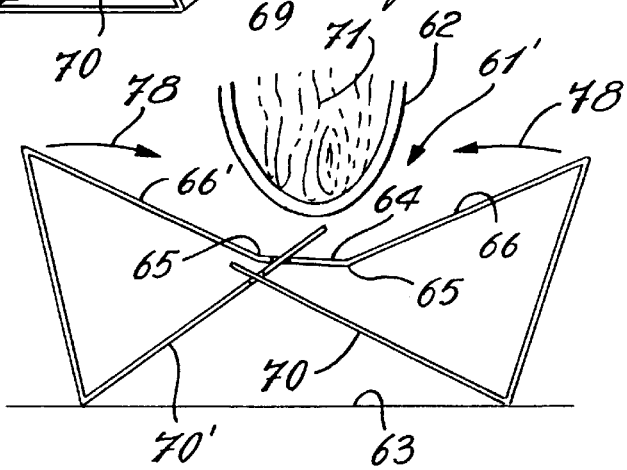
FIG. 11 is an end section view showing the position of the taco shell holder of FIG. 10 prior to a load being disposed in the receiving trough.
Figure 12:
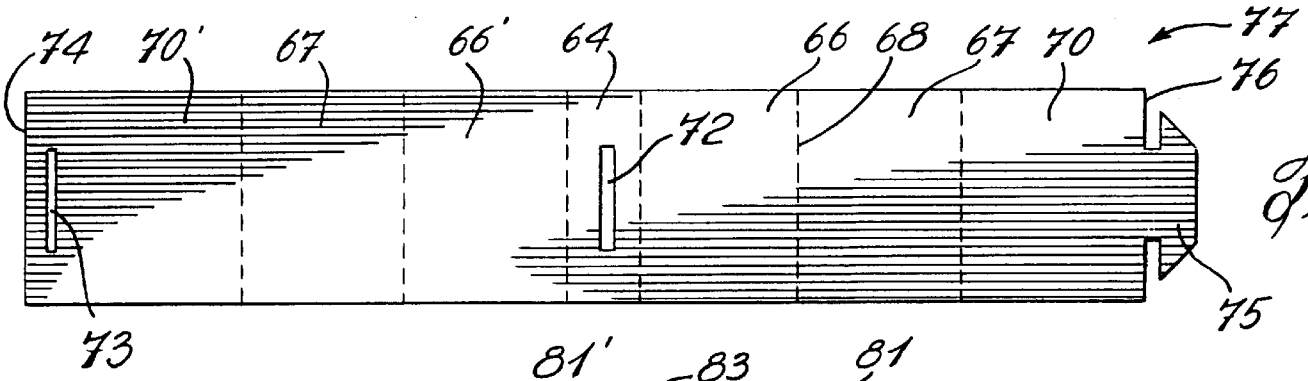
FIG. 12 is a plan view showing a blank of the taco shell holder of FIG. 10.

Referring now to FIGS. 10, 11 and 12, there is shown at 60 a modification of the taco shell holder of the present invention. As hereinshown the taco shell holder 60, when assembled in FIGS. 10 and 11, defines a taco shell receiving trough 61 to support a taco shell 62 substantially upright on a support surface 63. The receiving trough 61 is defined by a narrow longitudinal support base panel 64 having opposed longitudinal spaced-apart straight base fold edges 65. Outwardly inclined rectangular side wall panels 66 and 66' extend from each of the straight base fold edges 65 to form a substantially open V-shaped taco shell receiving trough 61' as better shown in FIG. 11.

A solid surface brace panel 67 extends from a straight top edge 68 of each of the side walls 66 and 66' to a base fold line 69. Each of the brace panels 67 project at an outward angle therefrom to the base fold line to which is connected a flat surface-engaging underlying connecting panel 70 adapted to lie in a substantially common or parallel plane with the support base panel 64 when a load, such as the taco shell 62 filled with foodstuff 71 is disposed over the support base panel 64.

The underlying connecting panels 70 bridge the straight base fold edges of the support base panel 64 and the straight fold line 69. As shown in FIG. 12, a connecting means in the form of a slot 72 is provided in the support base panel 64 as well as a slot 73 provided adjacent an end edge 74 of underlying connecting panel 70' and further an attachment tab 75 extending from the outer end edge 76 of the other underlying connecting panel 70. These connecting means co-act together, as better seen from FIGS. 11 and 10 to interlock the several panels of the blank 77, as shown in FIG. 12, to form the taco shell holder 60 of the present invention.

The underlying connecting panels 70 and 70' when secured to the base panel 64 provide a spring action, as shown in FIG. 11, causing the taco shell receiving trough 61' to be maintained in an elevated open-flared position over the support surface 63. Accordingly, when the taco shell 62 is disposed into the trough 61', the base panel 64 will be sent to the support surface 63 and simultaneously cause the side wall panels 66 and 66' to move inwardly in the direction of arrows 78 to clamp or embrace the taco shell 62 from opposed sides thereof to maintain the taco shell in an upright secure position on the support surface 63. Taco shells vary in size depending on its manufacture and may be available in "small", "standard" or "large" formats. It can therefore be appreciated that the trough of the present invention will adjust itself to embrace and clamp taco shells having variations in its base width.

Figure 13:
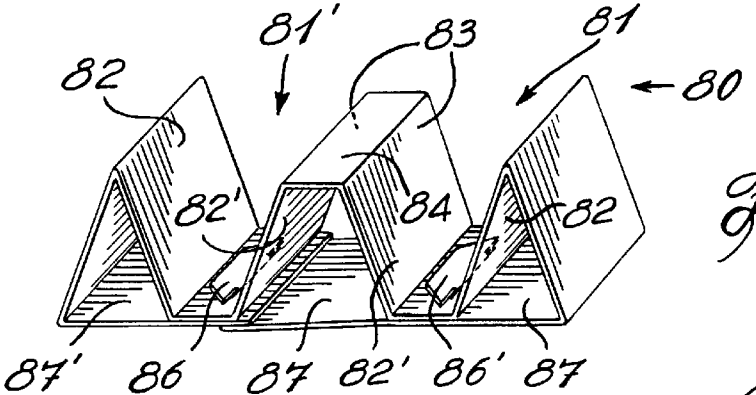
FIG. 13 is a perspective view showing a taco shell holder for holding two taco shells in side-by-side relationship and constructed in accordance with the embodiment of FIG. 10 and further including a central spacer panel to maintain the trough spaced apart from one another to permit taco shells disposed therein to be spaced from one another and to facilitate grasping of the taco shells.
Figure 14:
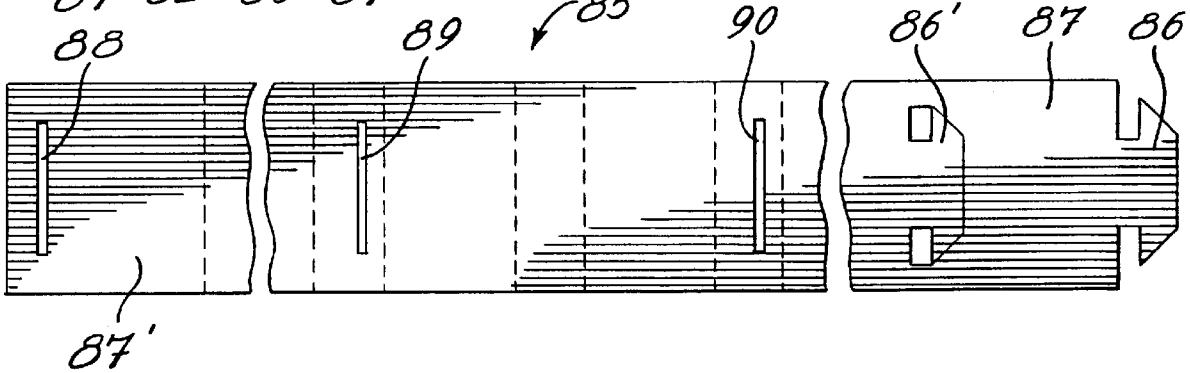
FIG. 14 is a plan view showing a blank for the construction of the twin taco shell holder of FIG. 13.

Referring now to FIGS. 13 and 14, there is shown a further modification of the taco shell holder of the present invention. As hereinshown generally at 80, the holder is a twin holder defining a pair of taco shell receiving troughs 81 and 81'. Each of these troughs have opposed side wall panels 82 but with the opposed ones of the side wall panels 82' of the pair of taco shell receiving troughs extend to opposed straight hinge edges 83 of a top rectangular spacer panel 84. The spacer panel provides for a spacing of taco shells disposed in the receiving troughs 81 and 81' to permit ease of grasping and placement of the shells into the troughs.

As illustrated in FIG. 14, the blank 85 has a plurality of panels which are disposed slightly different than that shown in FIG. 12 but obvious from the illustration as shown in FIG. 13 and what has been previously described with reference to FIGS. 10 to 12. As hereinshown two attachment tabs 86 are disposed within the end underlying panel 87 and spaced from one another. The end attachment tab 86 engages through both attachment slots 88 and 89 when the underlying panel 87' is folded as shown in FIG. 13. The other attachment tab 86' fits into the attachment slot 90 when the panel 87 is folded as illustrated in FIG. 13.

It is within the ambit of the present invention to cover any other obvious modifications of the preferred embodiment described herein, provided such modifications fall within the scope of the appended claims.

I claim:

1. A holder for a taco shell or the like, said holder comprising a taco shell receiving trough adapted for supporting a taco shell substantially upright on a support surface; said receiving trough being defined by a narrow longitudinal, rectangular support base panel having opposed longitudinal spaced-apart straight base fold edges, a pair of outwardly inclined rectangular side wall panels each extending from a respective one of said straight base fold edges to form a substantially V-shaped taco shell receiving trough and having spaced-apart diverging side walls; a solid surface brace panel extends downwardly from a straight top edge of each said side wall to a base fold line; each said brace panel projecting at an outward angle therefrom to said base fold line to which is connected a flat surface-engaging underlying connection panel adapted to lie in a substantially common or parallel plane with said support base panel when a load is disposed on said support base panel, said underlying connection panels bridging said straight base fold edges of said support base panel and said straight fold lines, connecting means at a free end of each said underlying connection panel and at said support base panel to maintain said support base panel, said side wall panels, and said underlying connection panel oriented in a taco shell support position, said underlying connecting panels, when secured to said base panel providing a spring action causing said taco shell receiving trough to be maintained in an elevated open flared position over said support surface whereby when a taco shell is disposed into said trough, said base panel will descend to said support surface and simultaneously cause said side wall panels to move inwardly towards one another to embrace said taco shell from opposed sides thereof to maintain said taco shell upright on said support surface.

2. A holder as claimed in claim 1 wherein said connecting means in said support base panel is a slot disposed substantially at mid-length between said straight base fold edges.

3. The holder as claimed in claim 1 wherein said connecting means at said free end of said underlying panels comprises an attachment tab formed along a free end edge of one of said underlying panels, and a slot formed adjacent a free end edge of the other of said underlying panels.

4. A holder as claimed in claim 1 wherein said holder is formed entirely from a single sheet of paperboard material having sufficient rigidity to support a taco shell with foodstuff placed in said shell.

5. A holder as claimed in claim 4 wherein said holder is formed as a flat blank of said paperboard material; said flat blank being an elongated rectangular strip delineating therealong said support base panel, said side wall panels, said brace panels, and said underlying panels.

* * * * *